United States Patent [19]

Vetterli

[11] 4,274,604

[45] Jun. 23, 1981

[54] WINDING MACHINE

[75] Inventor: Walter Vetterli, Winterthur, Switzerland

[73] Assignee: Rieter Machine Works, Ltd., Winterthur, Switzerland

[21] Appl. No.: 26,047

[22] Filed: Apr. 2, 1979

[51] Int. Cl.[3] ..... B65H 54/28; B65H 59/00

[52] U.S. Cl. ..... 242/43 R; 242/18 DD; 242/43.2; 242/45; 242/154

[58] Field of Search ..... 242/43 R, 43.2, 43 A, 242/18 DD, 153, 154, 45

[56] References Cited

U.S. PATENT DOCUMENTS

| | | | |
|---|---|---|---|
| 3,331,568 | 7/1967 | Okamura | 242/154 |
| 3,489,360 | 1/1970 | Torsellini et al. | 242/43 A |
| 3,640,477 | 2/1972 | Furst | 242/43 R X |
| 3,792,819 | 2/1974 | Schippers | 242/43 R |
| 3,861,607 | 1/1975 | Schippers et al. | 242/43 R |
| 3,945,581 | 3/1976 | Schippers et al. | 242/43 R |

FOREIGN PATENT DOCUMENTS

| | | | |
|---|---|---|---|
| 488726 | 4/1952 | Italy | 242/154 |
| 551829 | 3/1943 | United Kingdom | 242/154 |
| 552207 | 3/1943 | United Kingdom | 242/43 R |
| 945953 | 1/1964 | United Kingdom | 242/45 |
| 593769 | 3/1978 | U.S.S.R. | 242/154 |

*Primary Examiner*—Stanley N. Gilreath
*Attorney, Agent, or Firm*—Kenyon & Kenyon

[57] ABSTRACT

The winding machine is provided with a tension control means which is adjustable to vary the contact length over which a filament slides on a guide roller before being wound onto a mandrel. The guide roller and associated cam drum can be adjusted simultaneously via end plates which can be adjusted in templates fixed to the machine frame.

14 Claims, 5 Drawing Figures

WINDING MACHINE

BACKGROUND OF THE INVENTION

The present invention relates to winding machines. More particularly, this invention relates to a winding machine intended for winding continuous synthetic filaments such as those made of polyester and polyamide materials. In this specification, the term "filament" refers to a continuous mono-filament or multi-filament material.

In the production of a continuous synthetic filament, the filament is commonly drawn from a spinneret via a guide system to a wind-up device where it is formed into a package. The filament tension in the region of the spinneret is important to the filament producer because it affects the fineness (titer) of a filament and also the molecular orientation of the synthetic material. On the other hand, the filament tension in the region of the package is very relevant to the operation of the wind-up mechanism, since it has a substantial effect upon the quality of the package produced therewith and the performance of that package in subsequent filament treatment operations such as texturizing. It occurs only rarely, however, that an appropriate tension in the region of the spinneret is appropriate also for the production of a good quality package in the wind-up mechanism.

It has been common practice to provide a godet roller between the spinneret and the wind-up mechanism. The godet roller draws the filament from the spinneret at a tension appropriate to the spinneret and the wind-up mechanism can then take filament from the godet roller at a tension appropriate for winding. Thus, the godet roller "isolates" the tension conditions at the spinneret from those in the wind-up mechanism. However, the general trend is toward simplification of filament producing machinery and shortening of passage times between the spinneret and the wind-up. It is therefore desirable to eliminate the godet roller. The tension conditions in the region of the spinneret cannot be freely adjusted, since they are dependent upon the yarn type, desired titer, desired synthetic material etc., and it is therefore essential for the wind-up mechanism to accept the tension at the spinneret and to adjust the filament tension internally to an appropriate level for winding.

Attempts have already been made to cope with these problems. For example, U.S. Pat. No. 3,861,607 (DAS No. 2,435,898) describes a system which either includes a godet roller or which winds filament direct from the spinning nozzles. The U.S. patent describes a machine of a generally known type comprising a reciprocable thread guide from which the thread passes to a grooved roller before being laid onto the tube on which the package is being formed. The grooved roller is intended to perform two functions:

(a) at the end of each stroke of the reciprocable thread guide, the groove takes over guiding of the filament because it can produce a neater end on the package than the reversing thread guide, and (b) the depth of the groove varies along the axial length of the roller to compensate for changes in the running length of the filament due to reciprocation of the thread guide transverse to the length of the filament.

The prior art device is concerned with the form of the groove most suitable for eliminating variations in filament tension introduced by the changes in running lengths. The U.S. Patent does refer to overall adjustment (or selective setting) of the filament tension at the package by selection of three factors, namely:

(a) contact angle between the grooved roller and the thread, preferably 90°, (b) use of a mat finish on the grooved roller surface and in the groove to provide a low coefficient of friction, and (c) control of the peripheral velocity of the grooved roller.

The latter feature is used to permit adjustability of the thread tension of the filament leading to the winding package by adjustment of the peripheral velocity of the grooved roller.

There are two disadvantages in this method of adjustment, namely:

(a) the peripheral velocity of the grooved roller is not freely selectable over a wide range relative to the thread velocity; substantial variation in the velocity of the grooved roller will disturb the winding pattern given a constant thread speed, and (b) adjustment of the peripheral velocity of the grooved roller relative to the filament speed can have only a limited effect upon the winding tension regardless of the degree of variation permitted in the said relative velocities.

The present invention is based on the discovery that, given a determinable minimum speed differential between the grooved roller and the filament, the filament tension downstream of the grooved roller is relatively insensitive to additional speed differential, but is relatively sensitive to variation in the contact length between the filament and the grooved roller, i.e. to the wrap angle of the filament around the grooved roller.

It is therefore an object of the present invention to make use of the above discovery by providing a winding machine which is inherently capable of being set to produce a required general level of winding tension despite substantial differences in tension of filaments which may be supplied to the machine in use.

The present invention therefore provides a winding machine for winding a filament into a package, comprising means for receiving and rotating a bobbin so as to wind a filament onto the bobbin, and tension control means adapted to be contacted by the filament with sliding friction therebetween, characterised in that the tension control means is adjustable to vary the contact length over which the filament will experience sliding friction in use.

The sliding friction may be between the filament and one or more bodies in the winding machine. Where a plurality of bodies are provided, the contact length may be varied by bringing bodies into and out of contact with the filament. Preferably, however, the sliding friction is between the filament and a single body which may be in the form of a roller, the wrap angle of the filament around the roller being adjustable to vary tension in the filament downstream of the roller. In the preferred embodiment, the roller is a grooved roller, known per se, defining a reversal pattern for the filament at the end of a package.

The machine may incorporate each or any of a number of other features known per se; for example, the means for receiving and rotating a bobbin may be adapted to wind a filament onto the bobbin at a substantially predetermined speed of the filament longitudinally of itself. For this purpose, this means may include a bobbin receiving shaft and a separate drive roll adapted for frictional contact with the bobbin/package. The path of the filament onto the package may then include a predetermined wrap of the filament around the drive roll before contact with the bobbin/package.

In an alternative arrangement, also known per se, the means for receiving and rotating the bobbin comprises a shaft adapted both to receive and drive the bobbin, means being provided to vary the angular velocity of the shaft during winding of a package to produce a substantially constant and predetermined peripheral velocity of the bobbin/package. The velocity varying means may include velocity sensing means, e.g. a friction roller engaging the surface of the bobbin/package, to sense the peripheral velocity of the bobbin/package, and velocity control means responsive to the velocity sensing means.

It is not an object of the present invention to define any particular shape of groove for compensating running length variations in the filament, and thus for eliminating variations in the overall level of tension set by the tension control means. Such groove shapes are already known and are, for example, the subject of U.S. Pat. No. 3,861,607 amongst others. In general, the selection of an appropriate groove shape is merely the application of conventional geometrical principles to the calculation of the running length of the filament between the last fixed filament guide and the point at which the filament reaches the package, the groove depth being adjusted to maintain this running length constant as far as possible and subject to other operating conditions. Grooved rollers having known groove shapes, or new shapes calculated in accordance with the above or any other principle for eliminating tension variation from a set value, can be used with the present invention. Means other than a grooved roller may be used for the same purpose. Alternatively, it may be found that tension variation caused by running length variation can be tolerated in some uses and then neither the grooved roller nor any other means is needed.

It will be appreciated that the formation of a groove of precisely controlled and continuously varying depth in the surface of a cylindrical roller is not an easy matter from a production viewpoint and this is a very substantial disadvantage of existing rollers. The disadvantages are still further exacerbated by groove crossings because the groove edges in the crossing regions must be very carefully formed to avoid interference with the smooth guiding of the filament in these regions. While grooves are virtually essential for guiding the filament in the reversal regions of the filament's traverse to form the package, it is desirable to avoid the use of grooves wherever possible.

A second aspect of the invention therefore provides, particularly but not exclusively for use in a winding machine according to the first aspect, a grooved roller for a filament winding machine of the type having a filament guide system comprising a roller and a reciprocable filament guide for traversing the filament along a bobbin on which a package is being formed. In addition, the roller has grooves in the reversal regions corresponding with the ends of a package. The roller has two smoothly tapering portions which taper in opposite directions outwardly from the mid-length of the roller towards respective ends thereof and which at their smaller ends join respective relatively enlarged portions. The grooves are provided in respective relatively enlarged portions and the base of each groove at each end thereof joins smoothly with the adjacent smoothly tapering portion.

The smoothly tapering portions may be joined by a portion of substantially cylindrical cross-section at and adjacent the mid-length of the roller. Preferably, the grooves are provided solely in the relatively enlarged portions, without extending into the smoothly tapered portions. Where they do extend onto the smoothly tapering portions, however, the use of crossing grooves is preferably avoided. The radial distance between the rotation axis of the roller and the base of each groove may vary along the length of the groove in a generally known manner.

The smoothly tapering portions are preferably frustoconical and the relatively enlarged portions may have cylindrical cross-sections.

BRIEF DESCRIPTION OF THE DRAWINGS

By way of example, some embodiments of the present invention will now be described with reference to the accompanying diagrammatic drawings, in which.

DETAILED DESCRIPTION OF THE INVENTION

Figure 1:
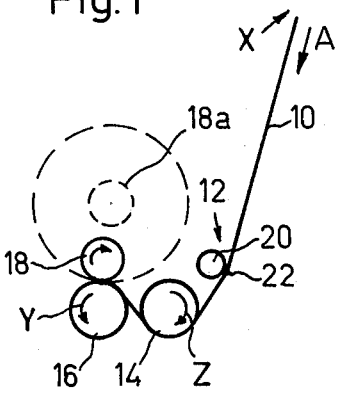
FIG. 1 is a diagrammatic side elevation of the most important elements of a winding machine according to the invention.

The winding machine shown diagrammatically in FIG. 1 is designed for high speed, cross-winding of a synthetic filament 10. Filament 10 is produced in a spinneret (not shown) and drawn away from the spinneret in the direction of the arrow A in FIG. 1 by the winding machine. In the immediately following description, it will be assumed that there is no tension adjustment means between the spinneret and the illustrated device so that the tension in the filament at the infeed location X in FIG. 1 is the same as the filament tension at the spinneret. This in turn will be directly dependent upon the characteristics of the filament which is being produced, for example upon the synthetic material from which the filament is made (polyamide, polyester or other filament forming material), the degree of molecular orientation required in the filament, the fineness of the filament and possibly other characteristics also.

FIG. 1 illustrates four basic elements of a winding machine; namely a traverse unit 12, a grooved filament guide roller 14, a friction drive roller 16 and a winding mandrel 18. These basic elements are in themselves well known and do not require detailed description. The traverse unit 12 comprises a cam drum 20 causing reciprocation of a thread guide 22 on a substantially straight line path parallel to the axis of the cam drum, that is substantially normal to the plane of the drawing. Filament 10 is caught by guide 22 and the filament is therefore reciprocated by the guide in a direction transverse to its length and its onward movement into the winding machine. After passing traverse unit 12, the filament passes around grooved roller 14 in a manner which will be further described below. The filament 10 then engages friction roller 16, which is rotated (by a positive drive system, not shown) in the direction of the arrow Y in FIG. 1. After passing around a portion of the periphery of the roller 16, the filament is "printed" onto mandrel 18 or a partially formed package thereon. Mandrel 18 is mounted by suitable bearings (not shown) for free rotation about the axis of a support shaft (not shown). In use, the mandrel includes a suitable tube (not illustrated) which is clamped into the mandrel structure during winding of the package but which can be released from the mandrel structure for removal with the package after completion of the winding operation.

At the start of the winding operation, mandrel 18 engages friction drive roller 16 as indicated in full lines in FIG. 1. Because of the frictional contact between the mandrel 18 and the roller 16, the mandrel 18 is driven in the indicated direction around a support shaft, thereby drawing filament 10 from the spinneret into the package which is being formed on the mandrel 18. Roller 16 is driven at a substantially constant angular velocity giving a constant peripheral speed and therefore a substantially constant speed of filament 10 in the direction of arrow A. The rate of reciprocation of guide 22 by cam drum 20 is selected in relation to the speed of filament 10 to produce a desired winding angle in the package by reciprocating the "lay-on" point of the filament on the package longitudinally of the axis of mandrel 18. As the package increases in diameter, the support shaft for the mandrel is moved away from friction roller 16, the final position of mandrel being indicated with dotted lines at 18' in FIG. 1 and the circumference of the package at completion of the winding operation being also indicated by dotted lines.

It will be noted that there is no movement of the "lay-on" point around friction roller 16 during the winding operation, and no relative movement of elements 12, 14 and 16 so that no tension variations are introduced by such movements during winding with this machine. Inevitably, some of the usual tension variations are introduced by the variation in the thread path within the triangle defined by a fixed input guide (say at the position X) and the ends of the reciprocation path of filament guide 22. A number of different ways of dealing with such tension variations will be discussed further below. However, they are not essential to the solution of the main problem dealt with by the present invention, namely the overall adjustment of the filament tension between the input guide at X and the package so that the filament tension at the package is appropriate for winding of a good quality package regardless of the input tension determined by the spinneret.

Figure 2:
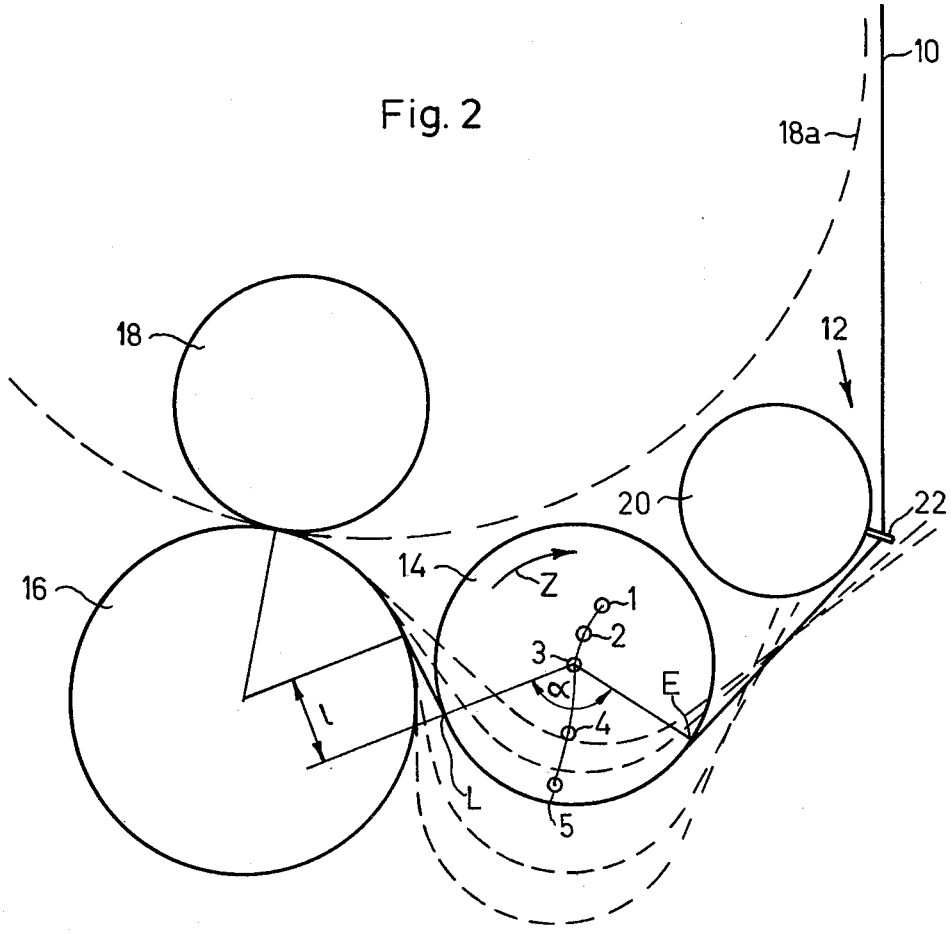
FIG. 2 is a similar elevation drawn to a larger scale and showing the relative adjustability of the components of FIG. 1.

It will be seen from FIG. 2 that as viewed in side elevation filament 10 first engages roller 14 at about the position E and leaves roller 14 at about the position L. This produces a "wrap angle" around roller 14 indicated by the symbol $\alpha$ in FIG. 2. Roller 14 is positively driven in the direction of the arrow Z shown in FIGS. 1 and 2 at an angular velocity such that there is a speed differential between the peripheral speed of the roller and the speed of movement of filament 10 around the roller. Thus, filament 10 is subjected to sliding friction through the full length of its contact with roller 14.

Such an arrangement is already known from the above quoted U.S. Pat. No. 3,861,607 and it is there suggested that the angular velocity of the grooved roller can be varied so as to adjust the tension in the filament downstream of the roller in relation to the tension upstream of the roller. Besides the disturbances in the winding pattern which may result from large variation in the angular velocity of grooved roller 14, however it is found, this method of adjusting the downstream tension relative to the upstream tension can only be effective within narrow limits because downstream filament tension is relatively insensitive to a speed differential greater than a certain determinable value (whether positive or negative). On the other hand, providing a certain minimum speed differential (whether positive or negative) is attained, then the downstream tension in the filament will be relatively sensitive to variation in the contact length over which the filament experiences sliding friction, that is, to the wrap angle $\alpha$ in the embodiment shown in FIG. 2. Therefore, in order to provide the winding machine with operating flexibility, enabling the machine to produce good quality packages despite unpredictable tension conditions at the input guide, the machine should be so adjustable that the contact length with roller 14 is selectively variable to enable correspondingly controlled variation of the filament tension downstream of the roller.

In the embodiment illustrated in FIG. 2, this variation in the contact length is achieved by varying the position of roller 14 relative to friction roller 16. Thus, roller 14 is adjustable in both directions away from the position illustrated in full lines (roller center at position 3 in FIG. 2) between a lowermost position (roller center at position 5) and an uppermost position (roller center at position 1). The roller could be continuously variable between these limits, but it is preferred to provide a plurality of preselected intermediate positions represented by roller centers 2 and 4 in FIG. 2. The positions of the roller centers are selected to lie on the path P such that the "drag length" l between the point at which the filament leaves the roller 14 and the point at which the filament 10 engages the roller 16 is kept as small as possible and as near constant as possible for all the selected positions of the roller 14.

Since the wrap angle around roller 14 depends upon the relative positions of the elements 12, 14 and 16, variation in the wrap angle could in theory be achieved by movement of any one or more of these elements relative to the others and to the machine frame (not shown). However, movement of the roller 16 relative to the machine frame would introduce difficulties in ensuring reliable "printing" of the filament on the package. Relative movement of the traverse unit and grooved roller would introduce difficulties because these two elements preferably have a common drive. Accordingly, the grooved roller 14 and traverse unit 12 are preferably mounted in a common support the position of which is adjustable relative to the machine frame to adjust the position of these two elements simultaneously relative to the friction roller 16 while maintaining elements 12 nd 14 in the same relative disposition. The resulting thread paths are shown in dotted lines for roller positions 1,2,4 and 5.

Figure 3:
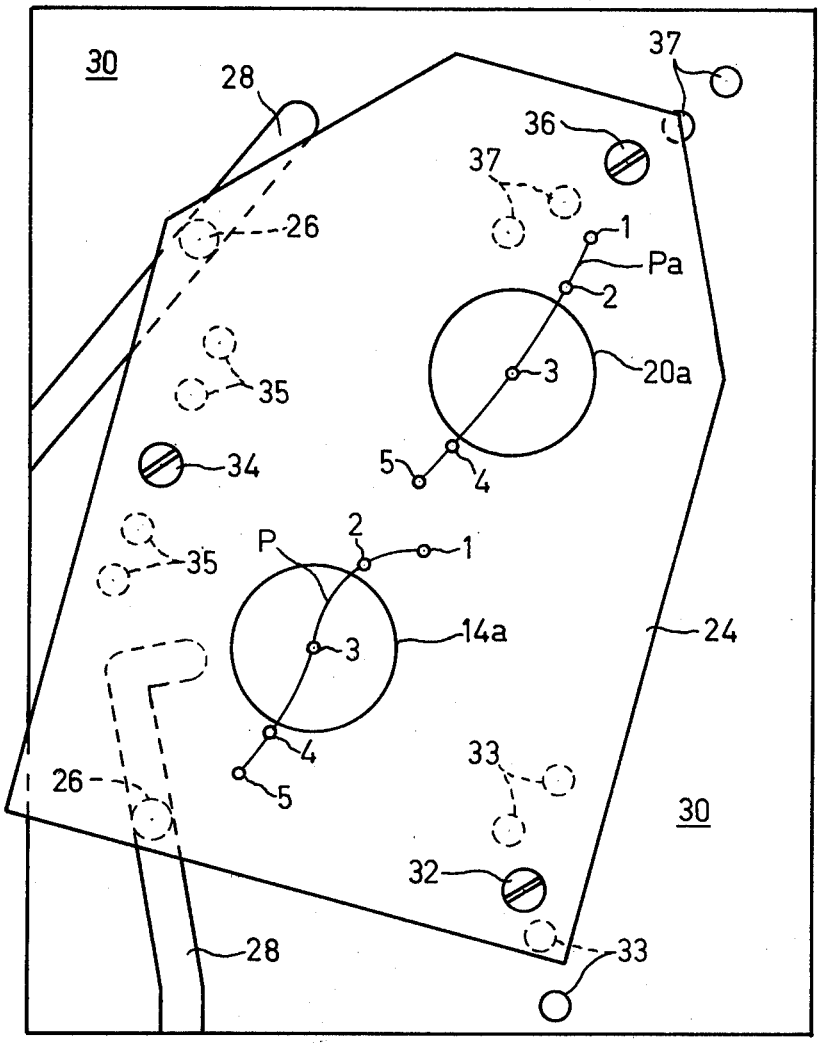
FIG. 3 is a side elevation of part of the same machine drawn to a still-larger scale to show mechanical details.

FIG. 3 shows a mechanical arrangement to enable adjustment of roller 14 and cam drum 20. For clarity of illustration, the roller and cam drum have been omitted from the Figure, but the paths of movement of their centers are indicated at P and Pa respectively. The roller and drum are mounted between a pair of end plates 24, only one of which is seen in FIG. 3. Each plate 24 carries a bearing for the roller —14*a*— and a bearing for the cam drum 20*a*. The ed plates 24 carry outwardly projecting pins 26 which extend into guide slots 28 in templates 30 fixedly mounted in the machine frame. Each end plate 24 also carries three fixing bolts, the heads of which are seen at 32, 34 and 36 respectively. For each fixing bolt there is a corresponding array of five threaded openings in the adjacent template 30. The openings for bolt 32 are indicated at 33, those for bolt 34 at 35 and those for bolt 36 at 37. The grooves 28 serve as guides for movement of the plates between the desired positions of the roller and cam centers, the plates 24 being held in the desired position by the bolts. The pattern of openings in each array therefore corresponds with the desired positions 1 to 5 of the grooved roller axis.

Selected positions and wrap angles clearly depend upon the filaments with which the machine is designed to work. U.S. Pat. No. 3,861,607 suggests a wrap angle of 90°. This appears to be too low; a minimum wrap angle of approximately 110° is preferred (this would correspond with the position 1 in FIG. 2, although that figure is not intended to be drawn accurately to scale in accordance with these recommendations). Clearly, the invention is not to be limited to this precise lower wrap angle, and it is possible that in certain circumstances, lower wrap angles, possibly even lower than 90°, would be appropriate. The maximum wrap angle will be dependant upon the geometry of the given machine. In FIG. 2, a wrap angle of approximately 190° is the maximum attainable. With any practicable winding machine geometry, the maximum possible wrap angle would be in the region of 250°.

Using a machine generally in accordance with FIG. 2, with a wrap angle variable between about 110° and 180° on a grooved roller 14 of approximately 120 cm diameter, it has proved possible to wind successfully packages of partially oriented polyester and polyamide materials without godet rolls between the spinning shaft and winding machine and with tensions in the spinning shaft between 0.12 grams per decitex and 0.35 grams per decitex. These quoted figures are not the limits of performance of the relevant machine; they represent only the operating conditions to which the machine could be subjected at the time the tests were made. It is not possible to measure accurately the winding tension. A low winding tension is indicated by "soft" packages, "overthrown" ends and filament breakages during "ribbon breaking". The use of a too high tension can be recognised by "hard"packages, "shoulders" at the package ends and by very strong "spirals" within the body of the package, these spirals representing tension variations which can change the quality of the filament from the point of view of the end user. Because it is not possible to measure the tension downstream of the grooved roller, and in any event it is impossible to predict in advance the winding tension which will be required for given operating conditions, it is necessary for the user to select the appropriate positions of the roller 14 and unit 12 by empirical methods prior to normal operation and then to operate with the selected conditions.

The necessity for a certain minimum speed differential between the filament and the periphery of roller 14 is referenced above. This speed differential is not a completely independent variable; its required value depends upon the characteristics of the filament, the surface characteristics of roller 14 and possibly upon environmental conditions. In general, a minimum speed differential of approximately 2% (positive or negative) appears to be necessary for the reliable production of the required sliding friction, and a speed differential in the range 4% to 6% (positive or negative) is preferred. Higher speed differentials result in increased wear without significantly reducing the filament tension downstream from the roller 14 and accordingly it is preferable not to use speed differentials greater than 6%, although such speed differentials are not excluded from the broad scope of this invention. Conventional, hard, wear-resisting surface coatings for roller 14 are suitable, for example, a coating of ceramic material such as aluminum-oxide. Given the minimum necessary wear-resistance of the roller surface, it is an extremely difficult matter to produce significant changes in the sliding friction of the roller on the filament by adjustment of the nature of roller surface, because the continual wear of the filament running over this roller surface eliminates minor differences in surface finish in a very short operating time.

As mentioned above, FIG. 2 illustrates the "print friction" type of drive roller 16. In this arrangement, the filament is laid on drive roller 16 and passes around a portion of the periphery of that roller before being laid on mandrel 18 or a package carried thereby. This system has two operating advantages; firstly, the frictional force between the filament and roller 16 transverse to the length of the filament is high relative to the corresponding frictional force between the filament and a mandrel 18 or package thereon. Accordingly, there is less risk of displaced windings if the filament is first laid on roller 16 and then "printed" onto the package, because the friction of the filament on the package is very low (coefficient of friction $\mu=0.3$). Secondly, there is a degree of static friction between the filament and the roller 16, and this tends to reduce the tension in the filament as the filament is laid onto the mandrel 18 or package. This static friction is to be distinguished from the sliding friction deliberately introduced at roller 14 since there is no speed differential between the filament and roller 16. While these operating advantages of the print friction roller are useful, they are not essential to the invention. There is an alternative known system using a friction drive roller in which the filament is laid directly upon mandrel 18 or its package before passing under the drive roller, and the tension adjusting principles of the present invention can be applied equally to this alternative drive system.

Friction drive systems are capable of producing winding speeds up to approximately 6000 m/min. For higher winding speeds, for example up to about 8000 m/min, it is desirable to use an alternative drive system, which is also already known. In this latter alternative, the mandrel is driven directly instead of via a friction roller such as roller 16. The drive must be controllable so that the angular velocity of the mandrel is variable during winding in order to maintain a substantially constant peripheral velocity on a package of steadily increasing diameter. One way of ensuring this is to use a friction roller contacting the periphery of package and serving merely as a sensing roller responsive to the peripheral velocity of the package. The sensing roller provides an output signal in suitable form for use with a control system for controlling the angular velocity of the mandrel drive. The filament is laid directly upon the mandrel or package. The tension adjusting principles of the present invention are again applicable to this alternative drive system.

Figure 4:
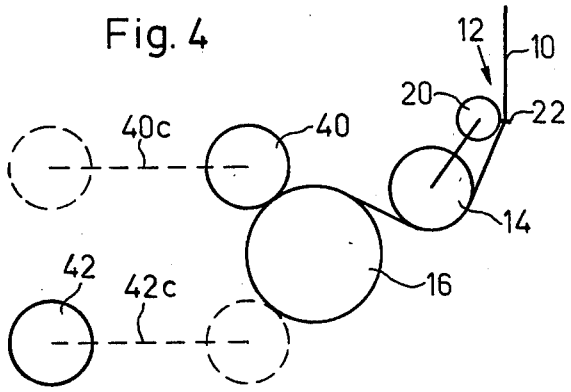
FIG. 4 is diagram similar to FIG. 1 and showing a modification.

A plurality of machines, each incorporating the tension adjusting principles set out above, can be arranged horizontally side by side and can also be vertically stacked, in a substantially known fashion. Within a machine having a friction drive roller 16, that roller may be associated with two or more mandrels adapted to be brought successively into contact with the single friction drive roller. A relatively simple arrangement of this type is shown in FIG. 4 in which the traverse unit 12, grooved roller 14 and friction drive roller 16 have the same numerals as in FIG. 1. The two mandrels are shown at 40 and 42 respectively. The center of each mandrel is movable on a straight line path 40C, 42C respectively so that the mandrel can be moved into and out of contact with drive roller 16 and the center of the mandrel can move away from the drive roller as the package size increases during winding.

With this arrangement, the filament must be transferred manually from one mandrel to the other after completion of winding of the package on the one mandrel, but the use of two mandrels reduces the waste which is inevitably associated with continuation of filament production at the spinneret during changeover of bobbin tubes while winding with a single mandrel. More complex machines enabling substantially wasteless mandrel exchange are already well known, for example as described in British patent specification No. 1,332,182 and in U.S. patent application Ser. No. 945,330, and the tension adjusting principles of the present invention can be applied to such machines also.

The grooved roller 14 has two functions to perform. The primary function is to define accurately a reversal pattern for the filament in the reversal region at the end of each stroke of traverse unit 12. Secondly, the grooved roller is designed to eliminate those tension variations in the filament which are introduced within the winding machine itself because of the transverse movement at unit 12 transverse to the length of the filament. For this purpose, the radial distance between the base of the groove in roller 14 and the axis of the roller is varied along the length of the roller according to a predetermined pattern.

It will be understood that the "grooves" in the roller may be provided by gouging material from a cylindrical roller so that the base of the groove lies radially inwardly of the roller surface, or by building material radially outwardly from a cylindrical surface. Further, it will be understood that in the latter case it is not necessary to provide a continuous "groove" around the circumference of the roller; the same effect can be achieved by providing a series of spaced "cam elements" mounted at intervals along a predetermined path on the roller surface. All of these variations are to be understood as falling within the term "grooved roller" used in this specification.

Figure 5:
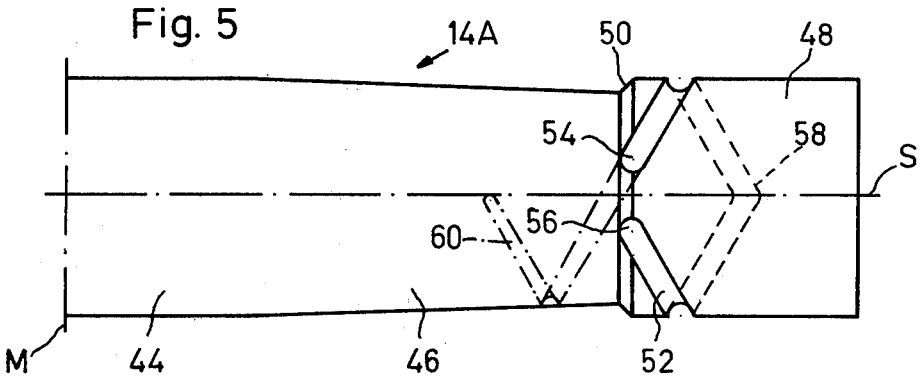
FIG. 5 is a side view of part of a roller which can be used in each or any of the arrangements shown in the preceding Figures.

A guide groove (whether within the surface of the roller or built outwardly therefrom) is essential for the primary function of the grooved roller described above, namely the definition of a suitable reversal pattern. FIG. 5 illustrates a roller 14A which can be used as the grooved roller 14 in any of the embodiments previously described but which is relatively simple in construction compared with the grooved rollers of the prior art. In a direction axially outwards from its mid-length M, (left-hand of FIG. 5) roller 14A has a cylindrical section 44, a frusto-conical section 46 and a second cylindrical section 48. Section 46 tapers axially outwardly (as shown) towards the section 48. For convenience, the latter has the same diameter as the section 44 so that a tapered shoulder 50 must be provided between sections 46 and 48. Section 48 is provided with a groove 52 having ends 54, 56 shown in full lines at the shoulder 50 and a sharply angled region 58 (for example, having a radius of about 20 mm) at the outer limit of the traverse stroke of the filament determined by the traverse unit 12. Since the roller is symmetrical about its mid-length, only half of that length is illustrated.

Section 46 tapers smoothly and is joined smoothly by the base of the groove 52 at both ends 54, 56 of the groove. The radial distance between the base of the groove and the axis S of roller 14A varies along the length of the groove. The degree of taper on frusto-conical section 46 and the variation in groove depth along the length of the groove 52 are selected to compensate for changes in the running length between the fixed guide at point X in FIG. 1 and the lay-on point on the package. It is neither necessary nor useful to set out suitable angles of taper for the section 46 or variations in depth of groove 52 since these depend upon the geometry of the individual system. Suitable patterns for individual systems have already been described in certain of the patent specifications referred to above. Others can be derived to fit different circumstances.

Variations in the illustrated form of the roller 14A are also possible. The frusto-conical section 46 may extend to the mid-length M, eliminating the cylindrical section 44. If desired, the groove may extend on to the frusto-conical section 46, for example as indicated in dotted lines at 60 in FIG. 5, but preferably at one end only thereby avoiding crossings of the groove with the guidance problems which such crossings always introduce. As indicated above, groove 52 may be provided by building outwardly from a relatively small diameter support instead of by gouging the material from a relatively large support as illustrated in FIG. 5. It could also be provided by a series of cam elements projecting outwardly from such a reduced diameter support.

The invention is also not limited to the use of a grooved roller, of whatever form, as the contact length varying means. For example, additional means could be provided to be brought into and out of contact with the filament at any desired point along a filament path defined within the winding machine. There could be a plurality of such elements, designed to be selectively brought into or out of contact with the filament to vary the effective contact length over which the filament experiences sliding friction. It is not necessary that these individual elements be formed as rollers or that they perform any function additional to that of adjusting the filament tension downstream of the contacting means. However, there are several advantages to the use of the grooved roller including the ability to incorporate the secondary, tension compensation function (for example, as described with reference to FIG. 5), the convenient geometry which results from the inclusion of this roller after the traverse unit minimizing the necessary increase in filament path between the fixed guide at X and the lay-on point on the package, and the avoidance of any undue distortion of the filament path within the winding machine, which distortion could lead to undesirable increases in filament tension.

The machine has been described for operation without a godet roller. It is not thereby intended to limit the claims to machines only when used without such rollers. A machine as described above is capable of accepting a wider range of input tensions than a normal machine while still producing good quality packages. With a given design of machine, certain production conditions may still demand tensions at the spinneret outside the range of those designed for the winding machine, and a godet roller then becomes essential. In any event, an individual user may choose to insert a godet roller even when operating at spinneret tensions within the range acceptable to the illustrated winding machines.

The machine has been illustrated with a friction drive roller 16 arranged below the mandrel 18. This arrangement is known in itself from DD Patent Specification No. 112 740. It is advantageous in reducing the load on the bearings of mandrel 18, but it is not essential to the invention and the more conventional arrangement using a friction drive above or to one side of mandrel 18 can also be adopted. Any convenient drive may be used for the grooved roller 14 and traverse unit 12. A suitable drive comprises an electric motor mounted within the grooved roller 14 and comprising a stator surrounded by a sleeve-like rotor, the rotor providing or carrying the grooved portion of the roller. Adjacent one end, the roller is provided with a gear connection enabling transmission of drive to a corresponding gear connection at the adjacent end of the cam drum 20. This drive arrangement is also of a known kind and other drives can be adopted if desired. Although the claimed structure of the grooved roller is not limited to any particular angles of taper for the smoothly tapered portion, it is suggested that for most machines the included angle at the apex of the cone should lie in the range 0.5° to 2.5°, preferably about 1° to 1.5°.

What is claimed is:

1. A grooved roller for a filament winding machine of the type having a filament guide system comprising said roller and a reciprocable filament guide for traversing the filament along a bobbin on which a package is being formed, said roller having grooves in the reversal regions corresponding with the ends of a package, wherein said roller has two smoothly tapering portions tapering in opposite directions outwardly from the mid-length of said roller towards respective ends thereof and at their smaller ends joining respective grooved portions, the base of each groove at each end thereof joining smoothly with the adjacent smoothly tapering portion.

2. A roller as claimed in claim 1, wherein the grooves are continuous grooves formed in respective relatively enlarged portions at the roller ends.

3. A grooved roller as set forth in claim 1 wherein said tapering portions taper at an angle in the range of 0.5° to 2.5°.

4. A grooved roller as set forth in claim 1 wherein said tapering portions taper at an angle in the range 1° to 5°.

5. A grooved roller as set forth in claim 1 which further has a portion of cylindrical cross-section at said mid-length of said roller.

6. A grooved roller as set forth in claim 1 wherein each grooved portion has a cylindrical cross-section.

7. A winding machine for winding a filament into a package, comprising first means for receiving and rotating a bobbin to wind a filament onto the bobbin, and tension control means adapted to be contacted by the filament with sliding friction therebetween prior to the filament reaching said first means, said tension control means including a grooved roller for contacting the filament at the end of a package and means for adjusting the position of said roller to vary the wrap angle of the filament around said roller thereby varying the contact length of the filament with said roller to adjust the filament tension downstream of said tension control means while maintaining a drag length between a point where a filament leaves said grooved roller and a point where the filament engages said first means near constant for all positions of said grooved roller.

8. A winding machine as set forth in claim 7 wherein said roller has a cylindrical mid-section, a pair of smoothly tapering portions tapering in opposite directions outwardly from said mid-section, a cylindrical section at each end, a shoulder between each tapering portion and respective cylindrical section, and a groove in each cylindrical section joining smoothly with an adjacent tapering portion.

9. A machine as claimed in claim 7 which further comprises a guide system for guiding the filament along the bobbin and said adjusting means adjusts the position of said roller relative to said guide system.

10. A winding machine for winding a filament into a package, said machine comprising a yarn traverse unit for reciprocating a travelling filament in a direction transverse to the direction of movement;

a grooved filament guide roller for contact with and passage of the filament from said traverse unit therearound over a given wrap angle;

first means for receiving and rotating a bobbin to wind a filament onto said bobbin from said guide roller; and means mounting said roller and said yarn traverse unit thereon for adjusting said roller relative to said first means to vary said wrap angle of the filament about said roller whereby the filament tension downstream of said roller is correspondingly varied while maintaining a drag length between a point where the filament leaves said guide roller and a point where the filament engages said first means near constant for all positions of said guide roller.

11. A winding machine as set forth in claim 10 wherein said adjusting means includes a pair of end plates rotatably mounting said guide roller and said yarn traverse unit therebetween, a pair of fixedly mounted templates, a pair of pins mounted on each respective end plate, a pair of slots in each template receiving said respective pins, and means for fixing each end plate to a respective template in one of a plurality of selected positions.

12. A winding machine as set forth in claim 10 wherein said wrap angle is in the range of from 110° and 180°.

13. A winding machine as set forth in claim 10 wherein said first means includes a freely rotatable mandrel and a friction drive roller in contact with said mandrel, said adjusting means maintaining said drag length between said drive roller and said guide roller.

14. A winding machine for winding a filament into a package, said machine comprising a yarn traverse unit for reciprocating a travelling filament in a direction traverse to the direction of movement;

a grooved filament guide roller for contact with and passage of the filament from said traverse unit therearound over a given wrap angle;

a friction drive roller for receiving the filament from said guide roller and for rotating a bobbin to wind the filament onto the bobbin from said guide roller; and means mounting said guide roller and said yarn traverse unit thereon in fixed relation to each other for adjusting said guide roller relative to said drive roller to vary said wrap angle of the filament about said guide roller whereby the filament tension downstream of said guide roller is correspondingly varied while maintaining said guide roller and said yarn traverse unit in fixed relation and while maintaining a drag length between a point where the filament leaves said guide roller and a point where the filament engages said drive roller near constant for all positions of said guide roller.

* * * * *

UNITED STATES PATENT AND TRADEMARK OFFICE

CERTIFICATE OF CORRECTION

PATENT NO. : 4,274,604

DATED : June 23, 1981

INVENTOR(S) : WALTER VETTERLI

It is certified that error appears in the above—identified patent and that said Letters Patent is hereby corrected as shown below:

Column 3, line 66, after "smaller ends" insert --,--

Column, 6, line 56, change "nd" to --and--

Column 6, line 67, change "ed" to --end--

Signed and Sealed this

*Third* Day of *November 1981*

[SEAL]

*Attest:*

GERALD J. MOSSINGHOFF

*Attesting Officer* *Commissioner of Patents and Trademarks*